US010687408B2

(12) United States Patent
Engelen et al.

(10) Patent No.: US 10,687,408 B2
(45) Date of Patent: Jun. 16, 2020

(54) METHODS, DEVICES AND A SYSTEM FOR TAKING OVER A LIGHT EFFECT BETWEEN LIGHTING DEVICES, WHEREIN EACH DEVICE COVERS A DIFFERENT COVERAGE AREA

(71) Applicant: SIGNIFY HOLDING B.V., Eindhoven (NL)

(72) Inventors: Dirk Valentinus René Engelen, Heusden-Zolder (BE); Berent Willem Meerbeek, Veldhoven (NL); Jochen Renaat Van Ghelluwe, Lommel (BE); Tim Dekker, Eindhoven (NL); Bartel Marinus Van De Sluis, Eindhoven (NL); Anthonie Hendrik Bergmall, Nuenen (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/345,914

(22) PCT Filed: Oct. 18, 2017

(86) PCT No.: PCT/EP2017/076557
§ 371 (c)(1),
(2) Date: Apr. 29, 2019

(87) PCT Pub. No.: WO2018/077685
PCT Pub. Date: May 3, 2018

(65) Prior Publication Data

US 2019/0289700 A1 Sep. 19, 2019

(30) Foreign Application Priority Data

Oct. 27, 2016 (EP) ..... 16195901

(51) Int. Cl.
*H05B 47/19* (2020.01)
*H05B 47/105* (2020.01)
*H05B 47/155* (2020.01)

(52) U.S. Cl.
CPC ..... *H05B 47/19* (2020.01); *H05B 47/105* (2020.01); *H05B 47/155* (2020.01)

(58) Field of Classification Search
CPC ..... H05B 37/0272; H05B 37/029; H05B 37/0227; H05B 33/08; H05B 33/0845; H05B 33/0872; H05B 37/02; H05B 37/0218; H05B 37/0254; A61B 2090/309; A61B 90/30; F21K 9/23; F21V 7/0091; F21Y 2107/10; F21Y 2107/20; F21Y 2115/10; G01B 11/14; Y02B 20/46
See application file for complete search history.

(56) References Cited

U.S. PATENT DOCUMENTS

2010/0271476 A1* 10/2010 Damink ..... H05B 37/0272 348/135
2013/0221858 A1 8/2013 Silberstein
(Continued)

*Primary Examiner* — Renan Luque
(74) *Attorney, Agent, or Firm* — Meenakshy Chakravorty

(57) ABSTRACT

A method of controlling a lighting device of a lighting system comprising a plurality of lighting devices, wherein the lighting device is controlled in such a way that a light effect is effectively handed over between the lighting devices such that a moving light effect can be rendered within the coverage area of the lighting system.

12 Claims, 5 Drawing Sheets

(56) References Cited

U.S. PATENT DOCUMENTS

| | | | | |
|---|---|---|---|---|
| 2013/0293116 | A1* | 11/2013 | Carreras Molins | H05B 33/0872 315/152 |
| 2013/0310652 | A1 | 11/2013 | Barsoum et al. | |
| 2014/0285096 | A1* | 9/2014 | Cuppen | H05B 37/0272 315/153 |
| 2016/0128140 | A1 | 5/2016 | Quilici et al. | |
| 2016/0198548 | A1 | 7/2016 | Monaci et al. | |
| 2017/0367785 | A1* | 12/2017 | Munari | H05B 33/0854 |

* cited by examiner

METHODS, DEVICES AND A SYSTEM FOR TAKING OVER A LIGHT EFFECT BETWEEN LIGHTING DEVICES, WHEREIN EACH DEVICE COVERS A DIFFERENT COVERAGE AREA

CROSS-REFERENCE TO PRIOR APPLICATIONS

This application is the U.S. National Phase application under 35 U.S.C. § 371 of International Application No. PCT/EP2017/076557, filed on Oct. 18, 2017, which claims the benefit of European Patent Application No. 16195901.0, filed on Oct. 27, 2016. These applications are hereby incorporated by reference herein.

FIELD OF THE INVENTION

The present invention generally relates to the field of lighting and, more specifically, to a method of controlling a lighting device in a lighting system comprising a plurality of lighting devices. The present invention further relates to a lighting system comprising a plurality of lighting devices, as well as a method of operating such a lighting system.

BACKGROUND OF THE INVENTION

Lighting systems comprising a plurality of lighting devices are being used nowadays for, amongst other, office and commercial applications. It is likely that the amount of deployed lighting systems will increase in the near future. For mid and long term office and commercial lighting, it is anticipated to adopt new light sources that will offer a broad scope of new capabilities to the user, in terms of colour, brightness level, beam directionality, beam shape, beam pattern, or dynamic effects. This enhanced functionality and flexibility in generating indoor light effects will result in a higher level of freedom for designing lighting scenarios.

Each of the above referenced lighting device is associated with its own coverage area and each lighting device is arranged for rendering a light effect within its own coverage area. Typically all coverage areas are adjacent to each other, or partly overlapping to each other. This has the effect that the total coverage area of the lighting system is increased.

Lighting systems as described above are typically deployed in situations with a relatively low ceiling. Multiple adjacently placed lighting devices are typically required in order to still be able to illuminate a large area, even in such low ceiling applications.

One of the drawbacks of the above described lighting system is directed to the collaboration of each of the lighting devices individually. That is, each of the lighting devices are arranged to provide its own illumination pattern on it corresponding coverage area.

SUMMARY OF THE INVENTION

It would be advantageous to achieve a method for controlling a lighting device of a lighting system such that said lighting device is collaborating with the other devices in the lighting system more intensively. It would also be desirable to achieve a lighting system or a single lighting device to enable more collaboration in rendering light effects.

To better address one or more of these concerns, in a first aspect of the invention, a method of controlling a lighting device of a lighting system comprising a plurality of lighting devices is provided, wherein each lighting device is associated with its own coverage area and wherein each lighting device is arranged for rendering a light effect within its own coverage area, wherein said plurality of lighting devices in said system are provided such that the corresponding coverage areas associated to the lighting devices are adjacent to each other and/or partly overlapping to each other, wherein each lighting device is further associated with its own observing area and wherein each lighting device comprises a camera arranged for observing its own observing area, wherein each observing area covers at least its corresponding coverage area, said method comprising the steps of:

detecting, by said camera of said lighting device, within its corresponding observing area, an incoming light effect in said observed area rendered by an adjacent lighting device in said lighting system; wherein the incoming light effect is a moving light effect with a speed and a trajectory;

determining, by said lighting device, that said incoming light effect is to enter said coverage area of said lighting device at a first entry location of said coverage area;

taking over, by said lighting device, said incoming light effect, by rendering, by said lighting device a light effect directed to a second entry location of said coverage area.

It was the insight of the inventors that a closer collaboration between lighting devices in a lighting system is obtained in case the lighting devices are able to autonomously take over a light effect rendered by an adjacent lighting device.

As such, the collaboration aspect is directed to the detection of an incoming light effect, determining a first entry location of the light effect at its coverage area, and rendering a light effect at a second entry location.

In an embodiment, said first entry location is identical to said second entry location.

Hence, the collaboration aspect is further directed to the detection of an incoming light effect, determining a (first) entry location of the light effect at its coverage area, and rendering a light effect (at a second entry location) at that identical (first) entry location. Taking over the incoming light effect occurs seamlessly.

As mentioned, typically the incoming light effect is a moving light effect. A moving light effect is defined as a light effect that visually moves along a coverage area with a certain speed. Said moving light effect may also be lighting scene. Said moving light effect may be a localized moving light effect within the overall coverage area of the lighting device.

It is noted that the incoming light effect in said observed area rendered by an adjacent lighting device in said lighting system may also be rendered by another type of device such as torch or the like. The torch may, for example, be used as a tool for initially creating the (moving) light effect.

In order to detect an incoming light effect, each lighting device is to be equipped with a camera. The camera has an observing area, wherein the observing area at least covers the corresponding coverage area of the lighting device. As such, each observing area is larger, i.e. encompasses, its corresponding coverage area. Further, the observing area should at least partly overlap with the coverage area of an adjacent lighting device.

The above enables the camera to detect an incoming light effect. That is, once an adjacent lighting device renders a light effect outside the coverage area of the lighting device but within the corresponding observing area of the camera, it may be flagged as possibly to be taken over. Then, the lighting device is to determine whether the detected, i.e. flagged, light effect is to enter its coverage area. If this is likely, for example by determining an expected trajectory of the detected light effect, an entry point at said coverage area of the lighting device is determined. Finally, the incoming light effect is taken over, by the lighting device, by rendering, by said lighting device, a light effect direct to the determined entry location of the coverage area.

The final step of the above mentioned method is directed to the rendering of the light effect at the determined entry location. The lighting device may render a same, or similar, light effect at the determined entry location. The lighting device may also ramp up the total illumination. That is, the light effect rendered by the lighting device may be fading-in. Further, the colour, shape, scene and/or speed of the light effect may be taken over by the lighting device, such that the obtained light effect, by the lighting device, does not substantially differ from the detected light effect.

In an alternative, the lighting device may also render a different light effect at the determined entry location. That is, for example, the incoming light effect is taken over by the lighting device but then with different properties for the light effect.

In another alternative, the lighting device renders a light effect at a second entry location other than the first entry location. As a result, the incoming light effect may comprise discontinuities in taking over the light effect. For example, this may be advantageous whenever a light effect is replicated in movement, such as in a saw tooth path to functionally indicate a preferred direction, for instance in case of emergency (lighting).

In accordance with the present disclosure, the light effect may be a spot light, i.e. a narrow beam for illuminating a small area within the corresponding coverage area. The light effect may also be a scene, such as a moving image or moving shape, or a dynamically changing light effect. The light effect may be an effect of a pixilated LED light spot.

In an embodiment, the step of determining comprises:

determining, by said lighting device, said first entry location by extrapolating a trajectory of the detected incoming light effect.

The above entails that the observing area of the camera of the lighting device also encompasses a part of the coverage area corresponding to the adjacent lighting device. As such, the camera is able to detect a light effect rendered by the adjacent lighting device.

The lighting device is then able to detect, or predict, whether the detected light effect will enter the coverage area of the lighting device. In order to do so, the lighting device may extrapolate a trajectory of the detected light effect. The trajectory can thus be seen as the expected path of the rendered light within its corresponding coverage area. Such a trajectory may, for example, follow a linear, parabolic or a polynomial extrapolation. The determination of the trajectory should be made in real-time or quasi real-time such that the first light effect is able to take over the rendering of the light effect without any noticeable delay.

In a further embodiment, the step of detecting comprises:

detecting, by said camera of said lighting device, any of a light intensity, colour, shape, size, scene, direction, modulation and speed of said incoming light effect.

The advantage of this embodiment is that the rendering step may take these parameters into account when rendering the same, or similar, light effect. This has the advantage that there are no, or hardly any, undesired effects noticeable when a light effect transitions from one lighting device to another lighting device within the same lighting system.

In a further embodiment, the step of detecting comprises:

detecting light codes encoded in said incoming light effect, said light codes being associated with light effect property information, And wherein said step of taking over comprises:

taking over, by said lighting device, said incoming light effect, by rendering, by said lighting device said light effect directed to said second entry location of said coverage area, wherein said light effect being rendered using said light effect property information.

In accordance with the present disclosure, the incoming light effect may be encoded with light codes. The light codes are decoded, interpreted or dereferenced by the camera so the light effect property information is retrieved. Decoding and interpretation means that all necessary information is present in the light codes itself. Dereferencing means that the light effect codes contain a reference to more networked information about the light effect and planned trajectory.

The light effect property information may be the information on the lighting properties of the light effect, operational parameters for the lighting device to render a light effect, instructions for the lighting device to provide an effect, instructions for the lighting device to create a specific light effect with certain parameters like colour, shape, speed, scene, etc.

In a further embodiment, the step of taking over comprises:

taking over, by said lighting device, said incoming light effect, by rendering, by said lighting device said light effect directed to said second entry location of said coverage area, wherein said light effect being encoded with a light code for indicating to said adjacent lighting device that said light effect is being taken over.

As mentioned above, it is preferred that the cameras of two adjacently placed lighting devices have a partly overlapping observing area. This makes it possible to communicate between adjacently placed lighting devices using the light codes encoded in the light effect. As such, the lighting device may encode the rendered light effect in such a way that the encoded light code indicates, to the adjacent lighting device, that the light effect is being taken over. This signal may then be used, by the adjacent lighting device, to fade-out its rendering of the light effect.

The encoded light codes may be encoded using a certain frequency and/or certain colour; for example visible light communication (VLC). Flickering of the rendered light at a frequency well above a frequency detectable by the human eye may be used for the communication. Of course, the cameras should be able to detect such a high flickering of the light.

The encoded light codes may thus also be encoded using non-visible light, i.e. light that is not visible for a user but can be detected by the camera of the lighting device. Another option if to use wireless communication for communicating the light effect property information directly between adjacent lighting devices. Such wireless communication may be based on Zigbee or Bluetooth protocols or anything alike.

The method steps as disclosed above may be performed by a control unit or any other type of control means. The control unit may be any type of hardware such as a microprocessor, a micro controller, a Field Programmable Gate Array, FPGA, or anything alike. The control unit may be empowered via an Alternating Current, AC, power supply or may be empowered using an auxiliary power supply such as a battery.

In a second aspect of the invention, there is provided a lighting device suitable for operating in a lighting system comprising a plurality of lighting devices, wherein each lighting device is associated with its own coverage area and wherein each lighting device is arranged for rendering a light effect within its own coverage area, wherein said plurality of lighting devices in said system are provided such that the corresponding coverage areas associated to the lighting devices are adjacent to each other and/or partly overlapping to each other, wherein each lighting device is further associated with its own observing area and wherein each lighting device comprises a camera arranged for observing its own observing area, wherein each observing area covers at least its corresponding coverage area, said lighting device comprising:

detector arranged for detecting, using said camera, within its corresponding observing area, an incoming light effect in said observed area rendered by an adjacent lighting device in said lighting system; wherein the incoming light effect is a moving light effect with a speed and a trajectory;

processor module arranged for determining that said incoming light effect is to enter said coverage area of said lighting device at a first entry location of said coverage area;

rendering module arranged for taking over said incoming light effect by rendering a light effect directed to a second entry location of said coverage area.

It is noted that the advantages and definitions as disclosed with respect to the embodiments of the first aspect of the invention, being the method of controlling the lighting device, also correspond to the embodiments of the second aspect of the invention, being the lighting device.

In an embodiment, said first entry location is identical to said second entry location.

In an embodiment, the processor module are further arranged for determining said first entry location by extrapolating a trajectory of the detected incoming light effect.

In a further embodiment, the detector are further arranged for detecting, using said camera, any of a light intensity, colour, shape, size, scene, direction, modulation and speed of said incoming light effect.

In another embodiment, the detector are further arranged for detecting light codes encoded in said incoming light effect, said light codes being associated with light effect property information, and wherein said rendering module are further arranged for taking over said incoming light effect by rendering said light effect directed to said second entry location of said coverage area, wherein said light effect being rendered using said light effect property information.

In yet a further embodiment, the rendering module are further arranged for taking over said incoming light effect by rendering said light effect directed to said second entry location of said coverage area, wherein said light effect being encoded with a light code for indicating to said adjacent lighting device that said light effect is being taken over.

In an embodiment, the lighting device may render a light effect which is split into two separate light effects. Said split may also be characterized by another integer number more than one. Such two separate light effects may for example have identical lighting properties (e.g. both circular spots), but with a different moving path. Said two separate light effects may for example also have different lighting properties (and follow a different moving path), e.g. one of such a light effect is taken-over as a circular spot while the other is taken-over as square spot. For example, a red square spot (incoming light effect) may enter a first entry location; this effect may be taken over by the lighting device by rendering a blue circle at the first entry location continuing the path of the incoming light effect; at the same time, the incoming light effect may be taken over by the lighting device by rendering another blue circle at a second entry location different from the first. Each separate light effect may have a separate entry location. Information related to such a split in take-over may also be comprised in a coded form within the light effect properties of the incoming light effect, wherein the code describes for example: 'take over the effect, split effect in two, change light effect shape and colour'. Said effect may propagate throughout the plurality of lighting devices.

Again referring to the first aspect of the invention, there is provided a method according to the first aspect of the invention, wherein said method further comprises the step of:

rendering, by a further lighting device of the plurality of lighting devices, a light effect within its corresponding coverage area and wherein said light effect is moving towards a coverage area corresponding to said lighting device of said plurality of lighting devices.

In an embodiment, said step of rendering, by said further lighting device comprises:

detecting a take-over of said rendered light effect, and reducing, by said further lighting device, an intensity of said rendered light effect.

In an embodiment, the further lighting device of the plurality of lighting devices is a handheld lighting device. For example a torch to project a light effect, for example an initial light effect to be taken over by said light source of the plurality of light sources.

It is noted that the advantages and definitions as disclosed with respect to the previous embodiments of the first aspect of the invention and the second aspect of the invention, being the method of controlling the lighting device and the lighting device itself respectively, also correspond to the embodiments of the first aspect of the invention mentioned here relating to the further lighting device.

In a third aspect of the invention, there is provided a method of operating a lighting system comprising a plurality of lighting devices, wherein each lighting device is associated with its own coverage area and wherein each lighting device is arranged for rendering a light effect within its own coverage area, wherein said plurality of lighting devices in said system are provided such that the corresponding coverage areas associated to the lighting devices are adjacent to each other and/or partly overlapping to each other, wherein each lighting device is further associated with its own observing area and wherein each lighting device comprises a camera arranged for observing its own observing area, wherein each observing area covers at least its corresponding coverage area, said method comprising the steps of:

rendering, by a second lighting device of said plurality of lighting device, a light effect within its corresponding coverage area and wherein said light effect is moving towards a coverage area corresponding to a first lighting device of said plurality of lighting devices;

detecting, by a camera of said first lighting device, within its corresponding observing area, said incoming light effect in said observed area rendered by second lighting device;

determining, by said first lighting device, that said incoming light effect is to enter said coverage area of said first lighting device at an entry location of said coverage area;

taking over, by said first lighting device, said incoming light effect, by rendering, by said first lighting device a light effect directed to said entry location of said coverage area.

It is noted that the advantages and definitions as disclosed with respect to the embodiments of the first aspect and the second aspect of the invention, being the method of controlling the first lighting device and the first lighting device itself, also correspond to the embodiments of the third aspect of the invention, being the method of operating a lighting system.

In an embodiment, the step of determining further comprises:

determining, by said first lighting device, said entry location by extrapolating a trajectory of the detected incoming light effect.

In an embodiment, the step of detecting comprises:

detecting, by said camera of said first lighting device, any of a light intensity, colour, shape, size, scene, direction, modulation and speed of said incoming light effect.

In a further embodiment, the step of detecting comprises:

detecting light codes encoded in said incoming light effect, said light codes being associated with light effect property information, and wherein said step of taking over comprises:

taking over, by said first lighting device, said incoming light effect, by rendering, by said first lighting device said light effect directed to said entry location of said coverage area, wherein said light effect being rendered using said light effect property information.

In another embodiment, the step of taking over comprises:

taking over, by said first lighting device, said incoming light effect, by rendering, by said first lighting device said light effect directed to said entry location of said coverage area, wherein said light effect being encoded with a light code for indicating to said adjacent lighting device that said light effect is being taken over.

In another embodiment, the step of rendering, by said second lighting device comprises:

detecting said light code in said light effect, and reducing, by said second lighting device, an intensity of said rendered light effect.

These and other aspects of the invention will be apparent from and elucidated with reference to the embodiment(s) described hereinafter.

It is noted that the advantages and definitions as disclosed with respect to the previous embodiments of the first aspect and the second aspect of the invention, being the method of controlling the lighting device and the lighting device itself, also correspond to the embodiments mentioned here related to the further lighting device.

These and other aspects of the invention will be apparent from and elucidated with reference to the embodiment(s) described hereinafter.

In an alternative aspect of the invention, a method of controlling a first lighting device of a lighting system comprising a plurality of lighting devices is provided, wherein each lighting device is associated with its own coverage area and wherein each lighting device is arranged for rendering a light effect within its own coverage area, wherein said plurality of lighting devices in said system are provided such that the corresponding coverage areas associated to the lighting devices are adjacent to each other and/or partly overlapping to each other; wherein the lighting system comprises a camera for observing an observing area and conveying observation data, and wherein each lighting device comprises a communication interface for receiving the observation data, and wherein the observing area covers at least a coverage area of a first lighting device; said method comprising the steps of:

detecting, by said camera, within the observing area, an incoming light effect in said observed area rendered by a second lighting device in said lighting system adjacent to the first lighting device in said lighting system, wherein the incoming light effect is a moving light effect with a speed and a trajectory;

receiving, by said first lighting device, observation data conveyed by the camera, wherein the observation data is indicative of the detected incoming light effect in said observed area;

determining, by said first lighting device, that said incoming light effect is to enter said coverage area of said first lighting device at a first entry location of said coverage area;

taking over, by said first lighting device, said incoming light effect, by rendering, by said first lighting device a light effect directed to a second entry location of said coverage area.

As such, the collaboration aspect is directed to the detection of an incoming light effect, determining a first entry location of the light effect at its coverage area, and rendering a light effect at a second entry location.

Said camera may at least be one camera. The observation data provided by the at least one camera may advantageously be used to control the plurality of lighting devices, because the at least one camera operates independent of each of the lighting devices. This is advantageous, since not every lighting device of the plurality of lighting devices requires a camera, which may add complexity and expense to the lighting system.

Hence, in the present alternative aspect of the invention, the provided/conveyed observation data of the at least one camera is an input for the first lighting device, but the intelligence of controlling the take-over of the incoming light effect may still remain at the lighting device.

The embodiments applying to the first aspect of the invention may apply mutatis mutandis to the alternative aspect of the invention as described here.

Moreover, in an alternative aspect of the invention, a lighting device suitable for operating in a lighting system comprising a plurality of lighting devices, wherein each lighting device is associated with its own coverage area and wherein each lighting device is arranged for rendering a light effect within its own coverage area, wherein said plurality of lighting devices in said system are provided such that the corresponding coverage areas associated to the lighting devices are adjacent to each other and/or partly overlapping to each other, wherein the lighting system comprises a camera for observing an observing area and conveying observation data, and wherein the observing area covers at least a coverage area of a first lighting device; said first lighting device comprising:

a communication interface for receiving the observation data, the observation data being indicative of an incoming light effect in said observed area rendered by a second lighting device in said lighting system adjacent to the first lighting device in said lighting system, wherein the incoming light effect is a moving light effect with a speed and a trajectory;

processor module arranged for determining that said incoming light effect is to enter said coverage area of said first lighting device at a first entry location of said coverage area;

rendering module arranged for taking over said incoming light effect by rendering a light effect directed to a second entry location of said coverage area.

Said communication interface may either be a wired interface (such as e.g, optical) or a wireless interface, such as e.g. Wi-Fi, ZigBee, IR, RF, Bluetooth, etc.

Said camera may be at least one camera. Conveying the observation data may for example be done via a camera controller or central server of the lighting system.

The embodiments applying to the first aspect of the invention may apply mutatis mutandis to the alternative aspect of the invention as described here. Moreover, in an alternative aspect of the invention, a lighting system is provided comprising a lighting device according to the invention and a camera.

DETAILED DESCRIPTION

Figure 1:
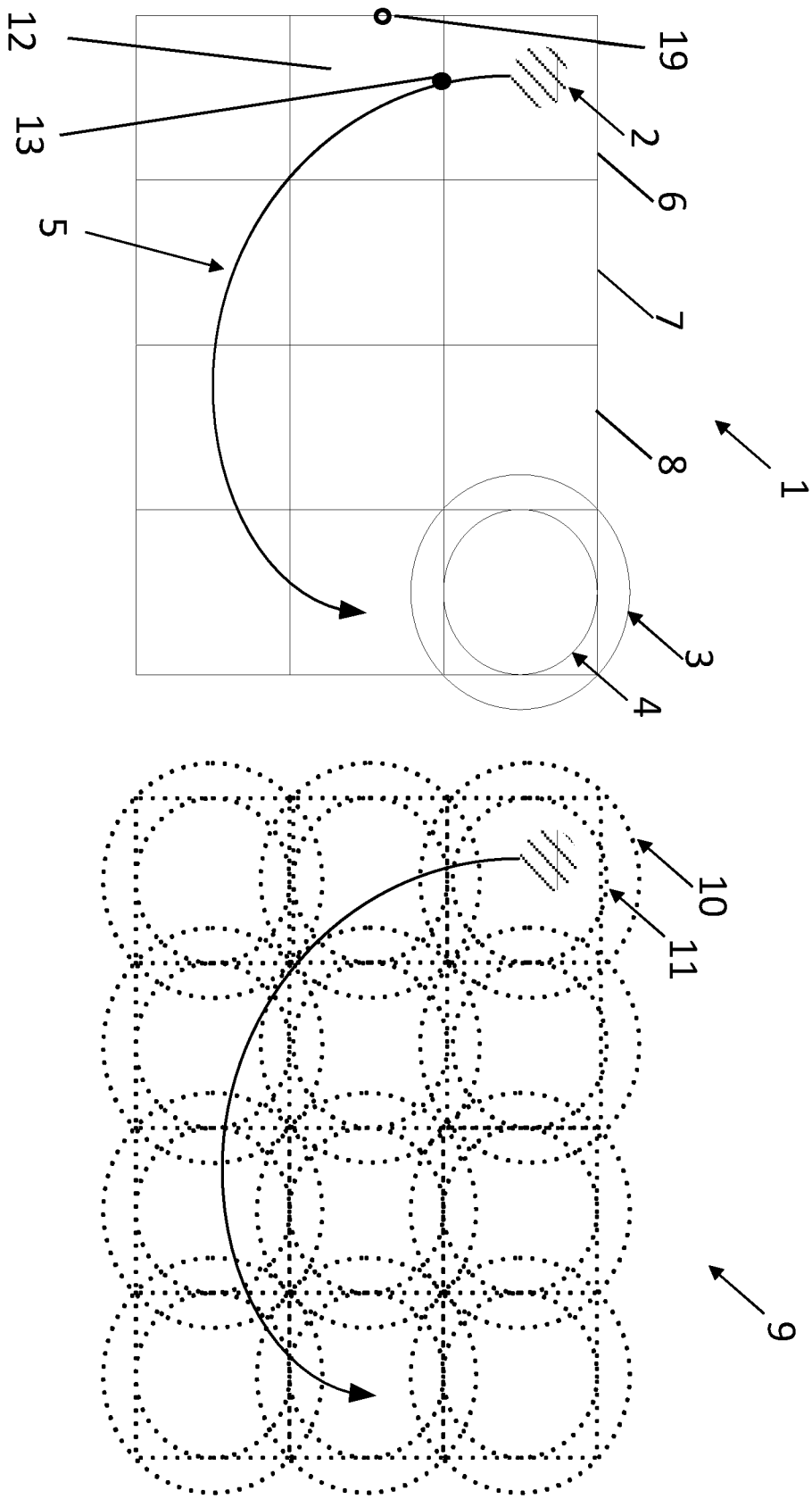
FIG. 1 shows an example of the basic concept of the patent application.

The basic implementation of the underlying concept of the present disclosure is depicted in FIG. 1. FIG. 1 represents a simplified lighting system according to the present invention. The left side, i.e. indicated with reference numeral 1, represents the top view of an area in which a moving light effect 2 is being rendered. The area is split into 12 equally sized squares, i.e. indicated with reference numeral 6, 7, 8. A single lighting device is installed in each of the centre points of the squares.

The right side, i.e. indicated with reference numeral 9, represents the top view of the area with indication of the coverage areas and the observing areas of each of the cameras of the lighting devices.

In the present situation, the spot light effect 2 is a light effect that moves over the total area given by the trajectory indicated with reference numeral 5. The trajectory 5 may be given by a certain function like a line, parabolic or a circle. Initially, the spot light effect 2 is rendered by a single lighting device, i.e. the lighting device corresponding to the square indicated with reference numeral 6.

As shown on the right side 9, each camera is coupled to an observing area 10 which is larger, i.e. it encompasses, the corresponding coverage area 11 of the corresponding lighting device. This is the case for each of the lighting devices. The right side 9 of FIG. 1 depicts a circular coverage area 11 and a circular observing area 10, wherein the both circles have substantially the same middle point, being the middle point of the corresponding square. The diameter of the circle of the observing area 10 is larger compared to the diameter of the circle of the coverage area 11.

Further, as shown on the right side 9 of FIG. 1, each observing area 10 also overlaps with a part of the coverage area of an adjacent, i.e. a neighbouring, lighting device. As such, a camera comprised by a single lighting device is able to detect a light effect rendered by a neighbouring lighting device.

In accordance with the present disclosure, a lighting device may comprise a large amount of individually controllable Light Emitting Diodes, LED's, able to generate multiple beams. By driving different collections of LED's, these light sources can create multiple light effects which appear to move to other locations or to change in shape. The functionality can be compared with one or more moving heads equipped with gobos, but then without mechanical movements or light-blocking elements. The lighting device may, for example, thus also be a pixilated light spot. It is however noted that the present invention is also applicable for these types of mechanical lighting systems.

Following the concept shown in FIG. 1, the camera of the lighting device, i.e. the lighting device corresponding to the square indicated with reference numeral 12, is able to detect an incoming light effect in its observed area rendered by an adjacent lighting device, i.e. the one corresponding to the square 6, in the lighting system. That is, according to the shown trajectory, the spot light effect 2 is moving downwardly towards the observing area of the camera corresponding to the square indicated with reference numeral 12. As shown on the right side 9, the observing area of the camera corresponding to the square indicated with reference numeral 12 overlaps with the coverage area 11 of the lighting device corresponding to the square indicated with reference numeral 6.

Once the spot light 2 has been detected, the lighting device determines an entry location 13 at which said light effect is to enter the coverage area 11 of the lighting device. That particular location 13 may be determined by extrapolating a travelled route of the light effect 2.

Finally, the lighting device will render a light effect directed to the entry location 13 of its coverage area. Typically, a same or similar light effect is rendered, i.e. having the same intensity, the same shape, the same colour and the same speed as the one detected by the camera. This smoothens the transition of the light effect from the first square as reference to by reference numeral 6 towards the second square, i.e. the one reference to with reference numeral 12.

Alternatively, the lighting device renders a light effect directed to a second entry location 19, which is a location turned ninety degrees counter-clockwise to said first entry location 13. The light effect may thus be taken over in a discontinuous fashion.

Alternatively, the lighting device renders a light effect which is split into two separate light effects (not depicted). The two separate light effects may be identical in properties, but with a different moving path. Said two separate light effects may also be different in properties and follow a different path. For example, a red square spot (incoming light effect) may enter the first entry location; this effect may be taken over by the lighting device by rendering a blue circle at the first entry location continuing the path of the incoming light effect; at the same time, the incoming light effect may be taken over by the lighting device by rendering another blue circle at a second entry location different from the first. Said take-over may also be comprised in a coded form within the light effect properties of the incoming light effect, wherein the code describes: 'taking over the effect, split effect in two, change light effect shape and colour'.

Figure 2:
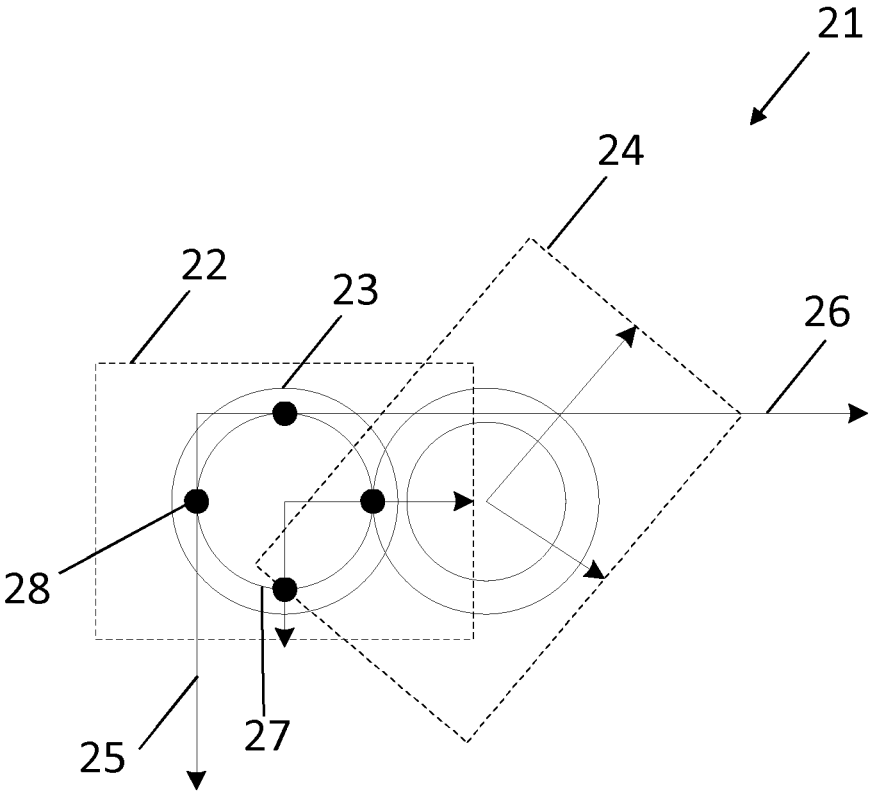
FIG. 2 shows an example of a concept in which the coordinate systems of each of the lighting systems is calibrated.

FIG. 2 shows an example 21 of a concept in which the coordinate systems of each of the lighting systems is calibrated.

In accordance with the present disclosure, the lighting system may be operated in a decentralized, a centralized or a distributed approach.

In a decentralized approach, each coverage area is smaller compared to its corresponding observing areas. This enables the camera to detect and predict movements of the light effect in its own coordination system. Such a decentralized system is possible without there being communication between the lighting devices. Communication, for example using light codes, may, however, still be useful to exchange more data and/or events.

It is also feasible that the coordinate system is derived by a central controller in a network of connected lighting devices. The controller may then assign an origin of the coordinate system 26, 27 to a single lighting device 22. This lighting device may render some light effect 28 at the borders 23, 27 of its reach, which can be pickup up by the cameras of an other lighting device 24. Together with the light effects, the absolute coordinates are communicated to each of the lighting devices. The cameras of the adjacent lighting devices notice the effects and location in their own coordinate system. With the knowledge of the absolute coordinates, they can re-calculate the translation and rotation of their coordination system relative to the absolute coordination system. In such a centralized approach, the trajectories of the light effects can be described in an absolute coordination system.

Using the centralized approach, it is more simple to select the preferred lighting device to render the effect for a particular amount of time, e.g. multiple lighting devices may have overlapping coverage areas at a certain location, but a single lighting device can render the effect only for a short period of time while another lighting device can extend the light effect for a longer time period.

The cameras are no longer necessary once the absolute and the relative coordination systems have been determined as the central controller has the overview of the light effects to be rendered and is able to instruct each of the individual lighting devices separately.

As such, the present disclosure is also directed to a method of controlling a lighting device of a lighting system comprising a plurality of lighting devices and a central controlling unit in communication with each of said plurality of lighting devices, wherein each lighting device is associated with its own coverage area and wherein each lighting device is arranged for rendering a light effect within its own coverage area, wherein said plurality of lighting devices in said system are provided such that the corresponding coverage areas associated to the lighting devices are adjacent to each other and/or partly overlapping to each other, said method comprising the steps of:

determining, by said central controlling, that a light effect rendered by a lighting device adjacent to said lighting device is to enter said coverage area of said lighting device;

determining, by said central controlling unit, that said incoming light effect is to enter said coverage area of said lighting device at a first entry location of said coverage area;

controlling, by said central controlling unit, said lighting device to take over said light effect, by rendering, by said lighting device a light effect directed to a second entry location of said coverage area.

In accordance with the present disclosure, the camera has a larger observing area compared to its corresponding coverage area. This enables the camera to observe light effects around its corresponding coverage.

The camera may measure light intensity, direction and speed of the light effect. From the observed trajectory of the light effect, an expected trajectory may be determined. The light effect may also comprise light codes which are decoded, interpreted or dereferenced by the camera so the light effect property information is retrieved. Decoding and interpretation means that all necessary information is present in the light codes itself. Dereferencing means that the light effect codes contain a reference to more networked information about the light effect and planned trajectory.

Figure 3:
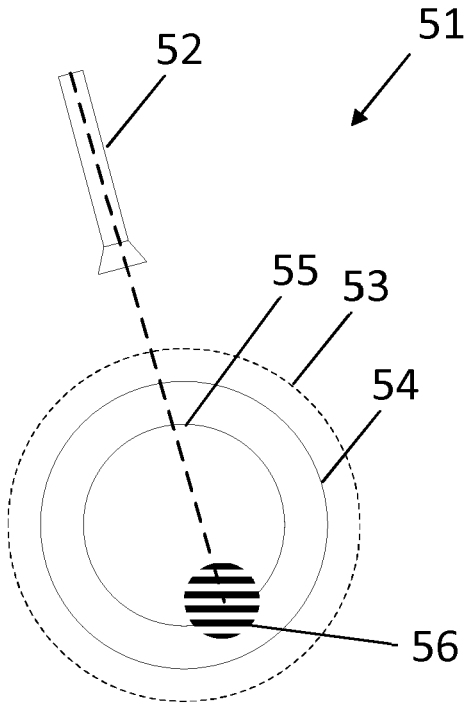
FIG. 3 shows an example in which a torch interacts with a lighting device.

FIG. 3 shows an example 51 in which a torch interacts with a lighting device.

The circle indicated with reference numeral 55 represents the coverage area of a lighting device in which only that lighting device is able to render a light effect. The circle indicated with reference numeral 54 represents the coverage area in which the lighting device is able to render a light effect but in which also another lighting device is able to render a light effect. The circle indicated with reference numeral 54 therefore represents an area in which a light effect can be handed over to an adjacent lighting device.

A torch device 52 may be used for creating an initial light effect. Several possibilities exist.

First, the torch 52 is a simple torch 52. This means that a light effect 56 is created and held at the same location. The camera of the lighting device may detect the light effect, as the light effect is rendered within its observing area 53, rendered by the torch 52 and the corresponding lighting device may take over rendering of the light effect 56.

Second, the torch 52 is a simple moving torch 52. This means that a light effect 56 is created and moved along the coverage area 55, 54. The camera may detect the rendered light effect and the corresponding lighting device may determine, or detect, the moving effect, estimate a desired trajectory and may take the rendering of the light effect over, along with the extrapolated, i.e. desired, trajectory. Whenever the light effect moves to an adjacent lighting device, i.e. outside the circle indicated with reference numeral 55 and towards the outside border of the circle indicated with reference numeral 54, it may be taken over by the adjacent lighting device in accordance with claim 1 of the present disclosure.

Third, the torch 52 is a simple torch in in a system having a centralized database. Here, a user may enter light properties of the effect in a centralized database. Subsequently, a light effect 56 is created, which is detected by the camera. The lighting device requests for the properties of the latest entered light properties in the database, and uses these properties to start rendering the light effect 56.

Fourth, the torch 52 is a smart torch in the sense that it is able to receive light properties of the light effect from a user. The torch 52 then renders a light effect 56 with embedded light codes. This light effect and coded information is detected by the camera, and the corresponding lighting device will then take over the light effect, along with the light codes embedded therein.

Fifth, the torch 52 is a so called networked torch 25. Here, a user may enter the light properties of the light effect in a centralized database, a reference to the database entry is returned to the torch 52, and the reference is embedded as a light code in the light effect rendered by the torch 52. The reference is detected by the camera and used to get the properties of the light effect that has to be rendered by the associated lighting device.

In an alternative approach, instead of a torch 52 a user can put a smartphone or tablet in the coverage area which shows an onscreen visualization representing the desired light effect. This could be an abstract visual identifier such as an identification code, such as a QR code, representing a specific spotlight effect, but it could also show an on-screen graphical image or animation of the desired light effect which is detected by the camera.

Figure 4:
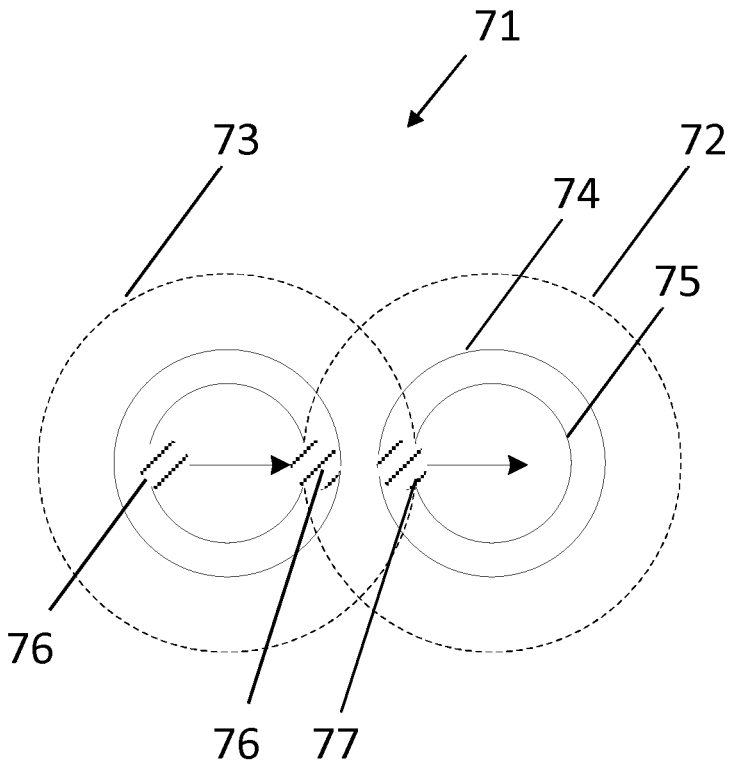
FIG. 4 shows an example in which a gap is bridged between two adjacently placed lighting devices.

FIG. 4 shows an example 71 in which a gap is bridged between two adjacently placed lighting devices;

According to the present disclosure, it is possible that some locations can not be reached by any of the lighting devices. That is, the coverage areas of the lighting devices do not need to intersect, i.e. be directly adjacent to each other. Further a lighting device may be operating faulty such that the lighting system is not able to illuminate the coverage area of the faulty operating lighting device.

In a system with centralized control, the controller tracks the virtual location of the lighting devices and instructs the lighting device when the effect location can be reached again. If desired the system can be instructed that in this eventuality the light effect 76, 77 instantaneously 'crosses' the gap, i.e. as it disappears from the light range of the lighting device, it is immediately generated in the coverage area 74, 75 of the second lighting device. This may be desired to avoid situations where the light effect 76, 77 would disappear.

In a decentralized, but connected, lighting system, it is possible that cameras have a larger observing area 72, 73, and see the light effect at the border of not-touching neighbouring lighting device. That is, the coverage areas of two adjacently placed lighting devices are free from each other. The detecting camera then starts the handover via the communication network by instructing the associated lighting device to fade-in, and the neighbouring lighting device to fade out.

Figure 5:
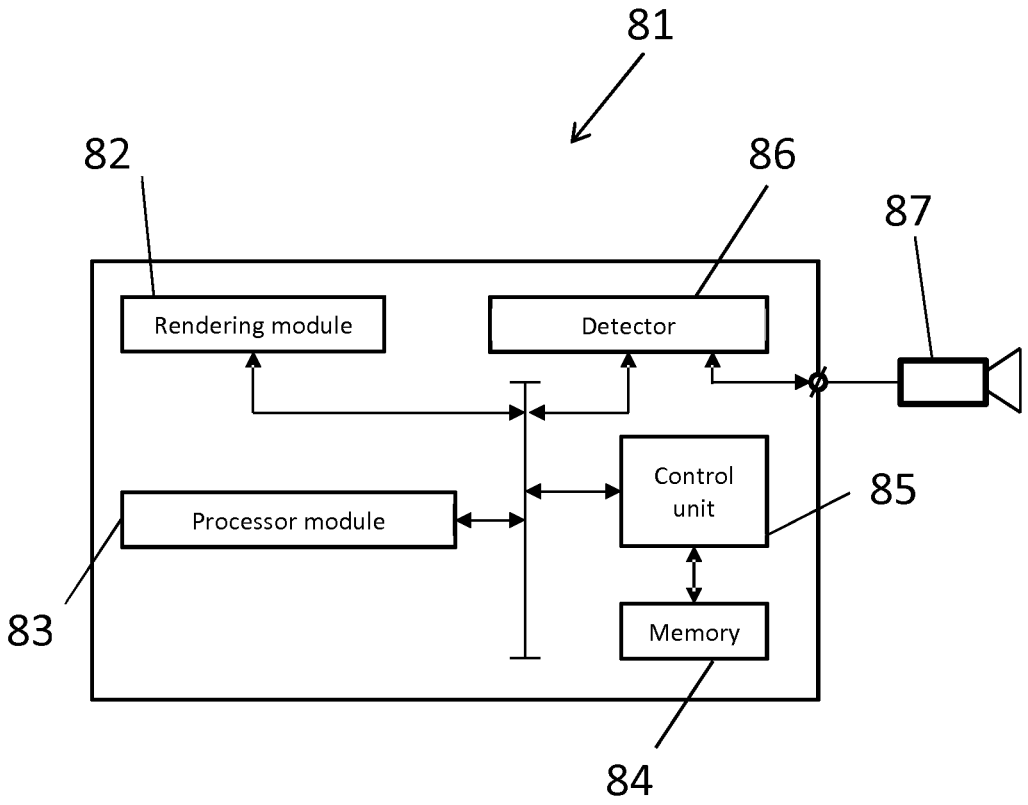
FIG. 5 shows an example of a lighting device according to the present disclosure.

FIG. 5 shows an example of a lighting device 81 according to the present disclosure.

The lighting device 81 is suitable for operating in a lighting system comprising a plurality of lighting devices, wherein each lighting device is associated with its own coverage area and wherein each lighting device is arranged for rendering a light effect within its own coverage area, wherein said plurality of lighting devices in said system are provided such that the corresponding coverage areas associated to the lighting devices are adjacent to each other and/or partly overlapping to each other.

Here, each lighting device is further associated with its own observing area and wherein each lighting device comprises a camera arranged for observing its own observing area, wherein each observing area covers at least its corresponding coverage area.

The lighting device 81 comprising:

detector 86 arranged for detecting, using said camera 87, within its corresponding observing area, an incoming light effect in said observed area rendered by an adjacent lighting device in said lighting system;

processor module 83 arranged for determining that said incoming light effect is to enter said coverage area of said lighting device at a first entry location of said coverage area;

rendering module 82 arranged for taking over said incoming light effect by rendering a light effect directed to a second entry location of said coverage area.

A control unit 85 may be provided, wherein said control unit 85 is connected to said processor module 83, said rendering module 82, said detector 86 and a memory 84. The control unit 85 may be arranged to control the operations of these different means.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfil the functions of several items recited in the claims. The mere fact that certain measures are recited in mutually different dependent claims does not indicate that a combination of these measured cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope thereof.

The invention claimed is:

1. A method of controlling a lighting device of a lighting system comprising a plurality of lighting devices, wherein each lighting device is associated with its own coverage area and wherein each lighting device is arranged for rendering a light effect within its own coverage area, wherein said plurality of lighting devices in said system are provided such that the corresponding coverage areas associated to the lighting devices are adjacent to each other, wherein each lighting device is further associated with its own observing area and wherein each lighting device comprises a camera arranged for observing its own observing area, wherein each observing area covers at least its corresponding coverage area and overlaps with a part of the coverage area of an adjacent lighting device, said method comprising the steps of:

detecting, by said camera of said lighting device, within its corresponding observing area, an incoming light effect in said observed area rendered by an adjacent lighting device in said lighting system; wherein the incoming light effect is a moving light effect with a speed and a trajectory and said step of detecting comprises detecting the direction and the speed of said incoming light effect;

determining, by said lighting device, that said incoming light effect is to enter said coverage area of said lighting device at a first entry location of said coverage area, wherein said step of determining comprises determining said first entry location by extrapolating the trajectory of the detected incoming light effect;

taking over, by said lighting device, said incoming light effect, by rendering, by said lighting device a light effect directed to a second entry location of said coverage area.

2. The method according to claim 1, wherein said first entry location is identical to said second entry location.

3. The method according to claim 1, wherein the light effect directed to the second entry location of said coverage area is different to said incoming light effect.

4. The method according to claim 1, wherein said moving light effect is a lighting scene.

5. The method according to claim 1, wherein said step of detecting comprises:

detecting, by said camera of said lighting device, any of a light intensity, colour, shape, size, modulation of said incoming light effect.

6. The method according to claim 1, wherein said step of detecting comprises:

detecting light codes encoded in said incoming light effect, said light codes being associated with light effect property information, and wherein said step of taking over comprises:

taking over, by said lighting device, said incoming light effect, by rendering, by said lighting device said light effect directed to said second entry location of said coverage area, wherein said light effect being rendered using said light effect property information.

7. The method according to claim 1, wherein said step of taking over comprises:

taking over, by said lighting device, said incoming light effect, by rendering, by said lighting device said light effect directed to said second entry location of said coverage area, wherein said light effect being encoded with a light code for indicating to said adjacent lighting device that said light effect is being taken over.

8. A method of controlling a lighting system comprising a plurality of lighting devices, wherein the method comprises the method of controlling a lighting device according to claim 1, and wherein said method further comprises the step of:

rendering, by the adjacent lighting device of the plurality of lighting devices, a light effect within its corresponding coverage area and wherein said light effect is moving towards a coverage area corresponding to said lighting device of said plurality of lighting devices.

9. The method according to claim 8, wherein said step of rendering, by said adjacent lighting device comprises:

detecting a take-over of said rendered light effect, and reducing, by said further lighting device, an intensity of said rendered light effect.

10. A lighting device suitable for operating in a lighting system comprising a plurality of lighting devices, wherein each lighting device is associated with its own coverage area and wherein each lighting device is arranged for rendering a light effect within its own coverage area, wherein said plurality of lighting devices in said system are provided such that the corresponding coverage areas associated to the lighting devices are adjacent to each other, wherein each lighting device is further associated with its own observing area and wherein each lighting device comprises a camera arranged for observing its own observing area, wherein each observing area covers at least its corresponding coverage area and overlaps with a part of the coverage area of an adjacent lighting device, said lighting device comprising:

detector arranged for detecting, using said camera, within its corresponding observing area, an incoming light effect in said observed area rendered by the adjacent lighting device in said lighting system; wherein the incoming light effect is a moving light effect with a speed and a trajectory and said step of detecting comprises detecting the direction and the speed of said incoming light effect;

processor module arranged for determining that said incoming light effect is to enter said coverage area of said lighting device at a first entry location of said coverage area, wherein said processor module is further arranged for determining said first entry location by extrapolating the trajectory of the detected incoming light effect;

rendering module arranged for taking over said incoming light effect by rendering a light effect directed to a second entry location of said coverage area.

11. The lighting device according to claim 10, wherein said first entry location is identical to said second entry location.

12. The lighting device according to claim 10, wherein said detector is further arranged for detecting light codes encoded in said incoming light effect, said light codes being associated with light effect property information, and wherein said rendering module is further arranged for taking over said incoming light effect by rendering said light effect directed to said second entry location of said coverage area, wherein said light effect being rendered using said light effect property information; and wherein said light effect being encoded with a light code for indicating to said adjacent lighting device that said light effect is being taken over.

* * * * *